US006691945B2

(12) United States Patent
Slezak

(10) Patent No.: US 6,691,945 B2
(45) Date of Patent: Feb. 17, 2004

(54) SPOOL DRIVE FOR TENSION CONTROL DEVICE

(75) Inventor: Raymond J. Slezak, Barberton, OH (US)

(73) Assignee: RJS Corporation, Akron, OH (US)

( * ) Notice: Subject to any disclaimer, the term of this patent is extended or adjusted under 35 U.S.C. 154(b) by 0 days.

(21) Appl. No.: 10/035,621

(22) Filed: Dec. 28, 2001

(65) Prior Publication Data

US 2003/0122024 A1 Jul. 3, 2003

(51) Int. Cl.[7] ..... B65H 16/10
(52) U.S. Cl. ..... 242/564; 242/420
(58) Field of Search ..... 242/421.8, 421.9, 242/597.8, 597, 597.6, 156.2, 420, 420.4, 564

(56) References Cited

U.S. PATENT DOCUMENTS

| | | | | |
|---|---|---|---|---|
| 969,529 | A | 9/1910 | Donnelly | |
| 1,506,890 | A | 9/1924 | Duncan | |
| 2,034,862 | A | 3/1936 | Dunham | 242/75 |
| 2,134,994 | A | 11/1938 | Zarafu | 117/41 |
| 2,179,334 | A | 11/1939 | Keyes | 57/18 |
| 2,904,277 | A | 9/1959 | Underwood | 242/68.3 |
| 2,923,493 | A | 2/1960 | Fitzgerald et al. | 242/156 |
| 2,998,878 | A | 9/1961 | Biedinger et al. | 197/175 |
| 3,036,785 | A | 5/1962 | Rossi | 242/46.2 |
| 3,134,556 | A | 5/1964 | Wasson | 242/96 |
| 3,224,702 | A | 12/1965 | Jones et al. | 242/68.4 |
| 3,899,143 | A | 8/1975 | Slezak | 242/156.2 |
| 4,458,857 | A | 7/1984 | Moore et al. | 242/197 |
| 4,929,012 | A | 5/1990 | Slezak | 294/86.41 |
| 5,024,477 | A | 6/1991 | Slezak | 294/81.2 |
| 5,163,727 | A | 11/1992 | Slezak et al. | 294/81.2 |
| 5,938,142 | A | 8/1999 | Halperin | 242/423.1 |
| 5,967,445 | A | 10/1999 | Yuyama et al. | 242/421.1 |
| 6,059,222 | A | 5/2000 | Yuyama et al. | 242/563 |
| 6,065,716 | A | 5/2000 | Munster | 242/597.6 |
| 6,092,755 | A | 7/2000 | Konishi et al. | 242/355.1 |
| 6,279,849 | B1 | 8/2001 | Martin | 242/422.8 |

OTHER PUBLICATIONS

RJS Corporation Drawing B 154–046 Mar. 1993.
RJS Corporation Drawing B 396–020 Jul. 1993.
RJS Corporation Drawing B 396–023 Feb. 1995.

*Primary Examiner*—John Q. Nguyen
(74) *Attorney, Agent, or Firm*—Renner, Kenner, Greive, Bobak, Taylor & Weber

(57) ABSTRACT

A spool drive (70) for selectively retaining a spool (S) having end flanges (96) with radial ribs (97) and a central contact area (98) about a bore (99) while filamentary material (F) on the spool is payed out under tension having, a spindle (25) adapted to receive the bore in the spool, a magnetic chuck (82) surrounding and rotatable with the spindle, and a positive flange engagement mechanism (85) associated with the magnetic chuck biased into contact with an end flange of the spool and adapted to engage the radial ribs to restrain rotational slippage between the magnetic chuck and the spool.

21 Claims, 3 Drawing Sheets

SPOOL DRIVE FOR TENSION CONTROL DEVICE

TECHNICAL FIELD

The present invention relates generally to an automatic tension control device for regulating the tension in a filamentary material being withdrawn from a spool. More particularly, the present invention relates to a magnetic spool drive which retains a spool of filamentary material rotatably mounted on a spindle in non-slipping engagement with a magnetic chuck secured to a brake drum. More specifically, the present invention relates to such a magnetic spool drive wherein the magnetic chuck includes a mechanism for positive mechanical engagement of the spool flange to restrain relative slippage during spool rotation.

BACKGROUND ART

Filamentary materials including fibers in single and multiple strands are produced in long lengths and conveniently wound on spools for various uses. The filamentary materials may be natural or synthetic fibers, glass or metal. Such filamentary materials are commonly used as reinforcement for plastic or elastomeric compounds or may themselves be fabricated into integral items as is done in the textile industry. Regardless of the application, it is customary to withdraw the filamentary material from the spool at or near the location it is being used. To facilitate such removal, the spool is customarily mounted on a tension control device or tension controller having a spindle which permits the spool to rotate as the filament is withdrawn under controlled tension. In many industrial applications, a plurality of filamentary materials are simultaneously incorporated into the product such that a number of tension control devices are mounted in an array or creel configuration in close proximity to each other.

In steel-belted radial tire building applications metal spools are employed which carry large quantities of steel filament such that a loaded spool is cumbersome and sufficiently heavy to be difficult to manually load onto the spindles of tension control devices mounted at various heights off the ground in a typical creel arrangement. As a result, powered creel loaders with spool grasping devices have been developed to assist in loading spools onto the spindles of an array of tension control devices. Nonetheless, problems have been encountered in properly positioning a spool on the spindle of a tension controller and maintain the spool properly positioned relative to a spool drive mechanism, particularly during operations where the tension in the filament is high or where extreme fluctuations may occur in the payout speed at which filament is withdrawn from a spool.

It has long been known in the industry to employ a drive pin mounted on the brake drum at a position located a distance from the spindle which engages a hole in the flange of the spool to thereby physically preclude the spool from rotating relative to the brake drum. In some instances, spool drives employing these drive pins have been known to create substantial noise on large creel arrangements due to the moving interengagement between the pin and the bore in the spool flange. Another disadvantage of the drive pin spool drive is that during rotation of the spool and spindle, the spool may move away from the drum and thereby disengage the drive pin, particularly in installations where the spindle is essentially horizontally mounted such that gravity does not assist in maintaining the spool engaged with the drive pin. A most significant disadvantage of the drive pin spool drive is the difficulty which an operator experiences when loading a spool of wire filament on a spindle because it is necessary to perfectly aligning the drive pin with the hole in the spool flange and assuring that it is fully inserted to be operational. In creels, which may have 40–50 or more tensions controllers, significant production time can be lost in properly mounting spools on each of the tension controllers.

A more recently developed spool drive employed a cylindrical magnet on a brake drum mounted within a generally cylindrical metal cup. The magnetic coupling provided for ease of mounting the spool on the spindle as absolutely no rotational alignment was necessary to align a drive pin with a hole in the spool flange or the like. However, with only magnetic coupling between the spool drive and the spool, undesirable relative rotation between the spool and the spool drive attached to the brake drum may take place under certain operating conditions.

A variation of the original magnetic drive employs a magnetized toothed ring which meshes with the raised radial ribs in the flange of the metal spools. The teeth engaging the flange between the ribs are said to provide a greater surface for magnetic attraction between the magnetized ring and the spool flange. This design, however, is subject to rotational disengagement between the spool and the spool drive during acceleration attendant starts and stops for filament payout. This takes place because the teeth, upon slight rotational slippage, ride up on the ribs so the teeth are disengaged from the area between the ribs so that the ring engages only the top of the ribs and the magnet is displaced axially therefrom. This reduces the magnetic attraction of the spool, thereby effecting rotational disengagement allowing slipping between the spool and the magnetic ring. In this disengaged condition, however, the magnetic force may be insufficient to re-engage the teeth of the ring with the flange of the spool between the ribs, thereby leaving the spool disengaged. This is particularly true in installations wherein the spindle is horizontal or substantially horizontal, rather than inclined, so that there is no gravity assistance in reseating the spool on the toothed ring.

DISCLOSURE OF THE INVENTION

It is an object of the present invention is to provide a tension controller for filamentary material which employs a magnetic spool drive to maintain a magnetic plastic or metallic spool of the filamentary material in engagement with the spool drive. Another object of the invention is to provide such a tension controller wherein the magnetic spool drive restrains the spool from both rotational and axial disengagement from the spool drive even during the acceleration attendant starting and stopping the payout of the filamentary material. A further object of the invention is to provide such a tension controller which employs a spool drive having a mechanical restraint in combination with a magnet to further restrain relative rotation or slippage between a spool and the spool drive.

Another object of the present invention is to provide a tension controller for filamentary material which employs a magnetic spool drive which is adaptable for operation despite manufacturing variations in various metal spools by a manufacturer and even variations in spools among different spool manufacturers. A further object of the invention is to provide such magnetic spool drive which has a positive flange engagement mechanism employing a plunger which engages the flange of a spool and particularly the raised rib thereon to restrain relative rotation between the spool drive and a spool. Yet another object of the invention is to provide such a magnetic spool drive having a flange engagement mechanism with a spring loaded plunger that provides resistance to rotational slippage by the plunger engaging a rib on a spool flange while permitting limited slippage under extreme rotational loading conditions by temporary retraction of the plunger yet allowing the spool to remain within the magnetic influence of the magnet. Another object of the invention is to provide such a magnetic spool drive wherein the magnetic spool drive couples a positive flange engagement mechanism with a tubular sleeve housing a magnet that engages a central contact area that may be recessed in the flange of a spool, thereby maintaining the spool in the area of magnetic influence of the magnet of the spool drive.

A further object of the present invention is to provide a tension controller which has a magnetic spool drive having a mechanical restraint to preclude relative rotation between a spool and the spool drive that permits random positioning of the spool relative to the spool drive during spool loading. Still another object of the invention is to provide such a tension controller that achieves consistent operation during all operating conditions with a minimum of operator supervision or intervention. Yet another object of the invention is to provide a magnetic spool drive for a tension controller that is of rugged construction, that can be easily repaired, and that can be retrofitted on existing tension controllers.

In general, the present invention contemplates a spool drive for selectively retaining a spool having end flanges with radial ribs and a central contact area about a bore while filamentary material on the spool is payed out under tension including, a spindle adapted to receive the bore in the spool, a magnetic chuck surrounding and rotatable with the spindle, and a positive flange engagement mechanism associated with the magnetic chuck biased into contact with an end flange of the spool and adapted to engage the radial ribs to restrain rotational slippage between the magnetic chuck and the spool.

BEST MODE FOR CARRYING OUT THE INVENTION

Figure 1:
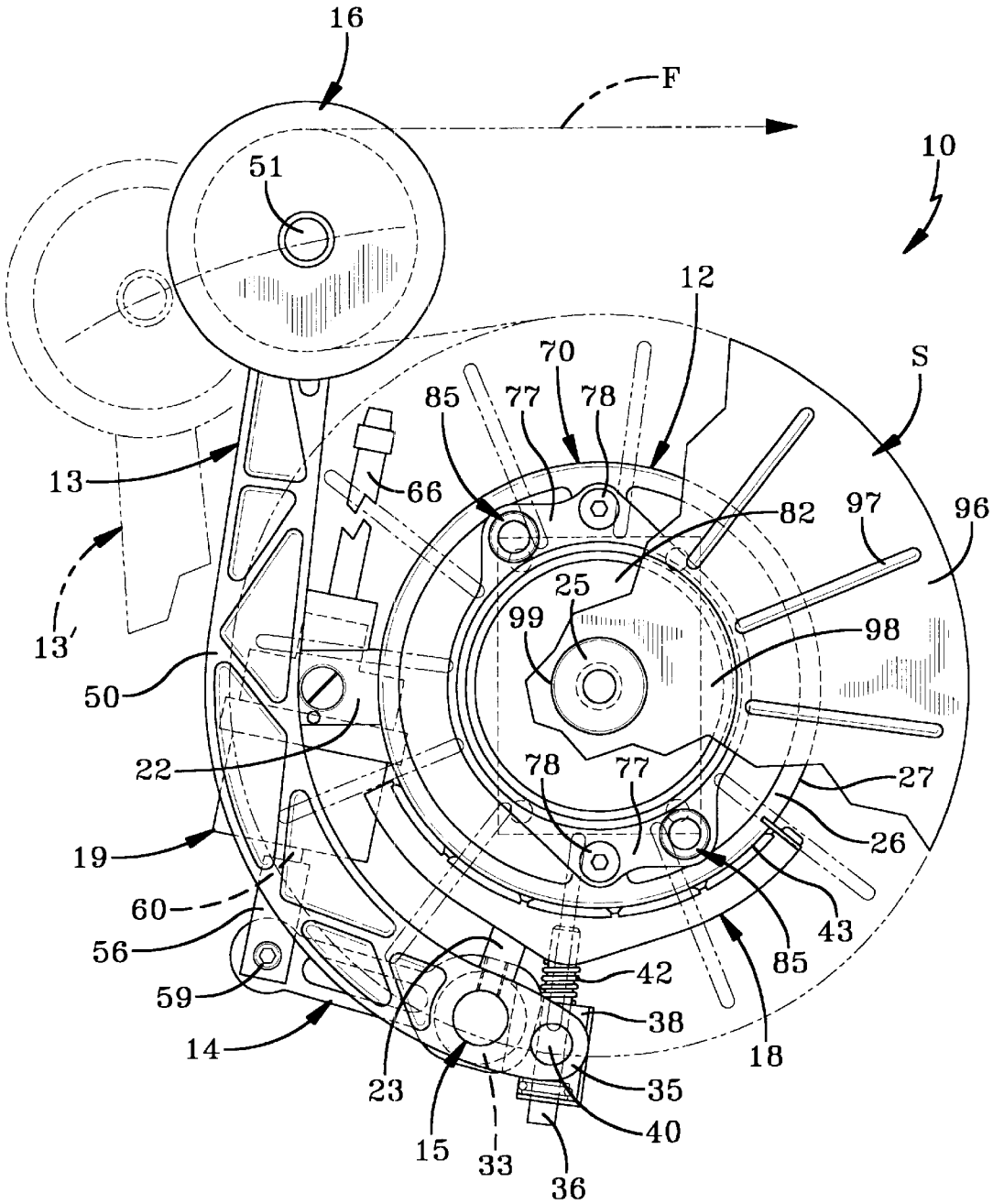
FIG. 1 is a front elevational view of a tension control device according to the concepts of the present invention with a conventional spool of filamentary material operatively mounted thereon and shown with portions broken away.
Figure 2:
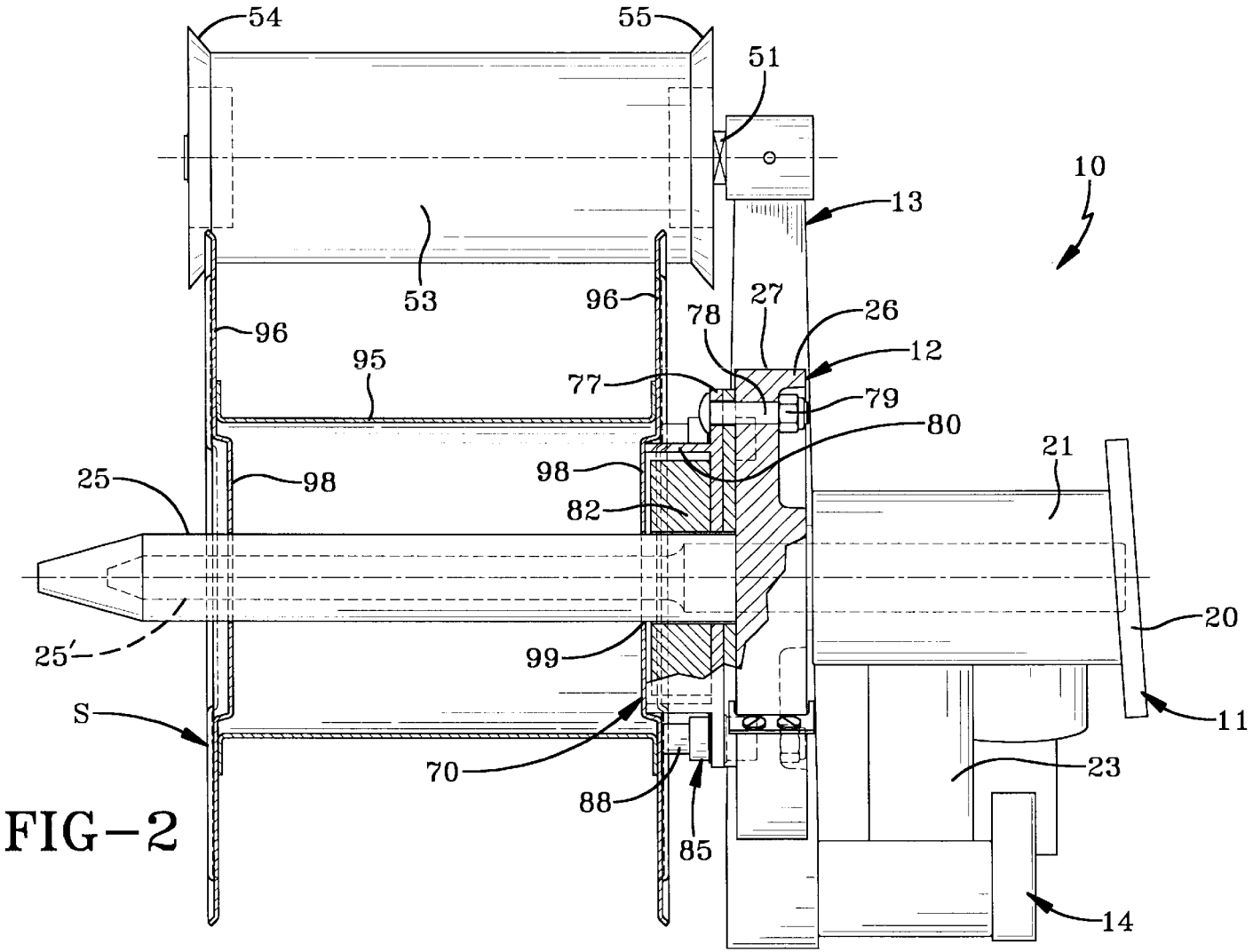
FIG. 2 is a side elevational view with portions broken away and parts in section of the tension control device of FIG. 1 showing details of the interrelation between a magnetic spool drive of the present invention and a conventional spool of filamentary material.

An exemplary tension control device for filamentary material embodying the concepts of the present invention is generally indicated by the numeral 10 in FIGS. 1 and 2. The tension control device 10 includes a support structure, generally indicated by the numeral 11, upon which a spool support assembly, generally indicated by the numeral 12, is mounted. A control lever assembly and a loading lever assembly, generally indicated by the numerals 13 and 14, respectively, are fixed on a pivot shaft, generally indicated by the numeral 15, rotatably carried by the support structure 11. The control lever assembly 13 carries a guide roller assembly, generally indicated by the numeral 16, and a brake shoe, generally indicated by the numeral 18. A fluid cylinder, generally indicated by the numeral 19, is connected to the loading lever assembly 14.

The support structure 11 includes a rectangularly shaped plate 20 that may be bolted to a suitable frame assembly (not shown) upon which an array of tension control devices 10 may be arranged in a manner well known in the art. Axially extending from the plate 20 is a bearing housing 21 which in turn supports two radially extending arms as shown, namely, laterally extending arm 22, and downwardly extending arm 23. As depicted in FIG. 2, the bearing housing 21 and plate 20 need not be perpendicularly related one to the other, thereby allowing spools of filamentary material F to be inclined relative to plate 20 and to a horizontal plane as the exemplary filament F is withdrawn so that it remains seated against the spool support assembly 12 described hereinafter. This angular relationship between the plate 20 and bearing housing 21 may be varied from 0 degrees to approximately 9° or more pursuant the requirements of a given operational application.

The spool support assembly 12 includes a spindle 25 that extends into the bearing housing 21 and is preferably rotatably mounted therein with anti-friction bearings. The spindle 25 is of a suitable length and diameter so as to pass through the center of a spool S positioned thereon. Various spindle diameters may be provided to accommodate spools S of differing sizes, such as spindle 25' depicted in FIG. 2. Mounted on the spindle 25 and rotatable therewith is a circular plate 26 which operates as a brake drum in having a smooth circumferential braking surface 27.

Attached to the end portion of the arm 23, extending from the bearing housing 21, is a cylindrical housing 33 which receives the pivot shaft 15, freely rotatable therein. On the outboard end of the pivot shaft 15, i.e., away from the plate 20, the elongated, curved control lever assembly 13 is non-rotatably secured.

As depicted in FIG. 1, the control lever assembly 13 is pivotable toward and away from the spindle 25. The control lever assembly 13 terminates a short distance beyond its connection with the pivot shaft 15 in a clevis 35. The brake shoe 18 is supported by a cylindrical stem 36 having a block 38 thereon which is received by the clevis 35. The stem 36 passes freely through the block 38 and a pin 40. The pin 40 passes through a bore in the clevis 35 and through the block 38, permitting a limited amount of pivotal movement therebetween as the control lever assembly 13 pivots about the pivot shaft 15. A spring 42 mechanically connects block 38 and brake shoe 18.

The portion 50 of the control lever assembly 13 located to the other side of pivot shaft 15 from brake shoe 18 carries the guide roller assembly 16 rotatably mounted on a shaft 51 extending substantially perpendicular to the control lever assembly 13 and substantially parallel with the spindle 25 and the spool S mounted thereon. The guide roller assembly 16 preferably includes a smooth cylindrical metal drum 53 over which the filament F passes. As the filament F is payed out from the spool and passes over the drum 53, it is maintained thereon by lateral flanges 54 and 55. The drum 53 is preferably dimensioned to be as long as the axial length of a spool S to insure the smooth and uniform withdrawal of the filament F from the spool S without fouling or substantial deflection.

The loading lever assembly 14 is non-rotatably secured at one end of the pivot shaft 15, the lever assemblies 13 and 14 and the pivot shaft 15 being rotatable with respect to the cylindrical housing 33 through which the pivot shaft 15 passes. At the opposite end of the loading lever assembly 14, a yoke 56 is affixed as by a nut and bolt 59. The upper end of yoke 56 is connected to a piston rod 60 which extends from the fluid cylinder 19, which is preferably a low-friction, rolling-diaphragm type of cylinder designed for pneumatic operation. The upper end portion of the cylinder 19 is preferably pivotally fixed to the arm 22, laterally extending from the bearing housing 21. The cylinder 19 is supplied with operating air at its upper end by an air hose 66 connected to a suitable source of air pressure (not shown). The air hose 66 may be connected to a manifold (not shown) which services a plurality of tension control devices 10. In operation a spool S of filamentary material is mounted on the spindle 25, and an end of the filament F is led from the top of the spool S, under and around the guide roller assembly 16 in a clockwise direction (see FIG. 1) and to a take-up mechanism (not shown). Prior to actuating the take-up mechanism, the control lever 13 and guide roller assembly 16 will repose displaced from the spool S, as depicted in chain line position 13' in FIG. 1. At this time, the brake shoe 18 urges the brake shoe lining 43 into firm engagement with the braking surface 27, thereby arresting rotation of the circular backing plate 26 and spool S so that the filament F cannot be payed out.

As the filament F is taken up, it will draw the guide roller assembly 16 and control lever assembly 13 toward the spool S and in so doing, will reduce the friction force between the brake shoe lining 43 and the braking surface 27, permitting the spool S and backing plate 26 to rotate. The force exerted on control lever assembly 13 by the filamentary material in engaging guide roller assembly 16 is balanced against the friction between the brake shoe lining 43 and braking surface 27 to maintain a constant tension in the filament F. The tension from this force-balance system is, within normal operating limits, independent of the coefficient of friction between the braking surfaces. In the event the take-up decreases in rate or ceases, the requisite amount of braking is immediately applied so there is never any undesirable slack created in the filament F. Likewise, upon an increase in the rate of take-up, the balance between the braking force and the force applied by the cylinder 19, permits a smooth and uniform rate of payout without stretching or jerking of the filament F.

By applying a relatively low amount of air pressure to cylinder 19, the piston rod 60 tends to urge the loading lever assembly 14 to rotate in a counterclockwise direction, thereby applying a torsional force about the pivot shaft 15, producing a desired tension force in the filament F. Since this torsional force must be overcome by the force exerted on control lever assembly 13 by guide roller assembly 16, as produced by the tension in filament F, before the control ever assembly 13 rotates in a clockwise direction as seen in FIG. 1, it constitutes a biasing force substantially proportional to the tension in the filament F. Thus, the tension in filament F may be selectively varied by controlling the air pressure in cylinder 19.

The aforedescribed tension control device 10 is substantially in accordance with applicant's assignee's prior U.S. Pat. No. 3,899,143. Reference may be made to that patent for additional details regarding the structure and operation of the tension control device 10 depicted herein and thus far described.

Figure 3:
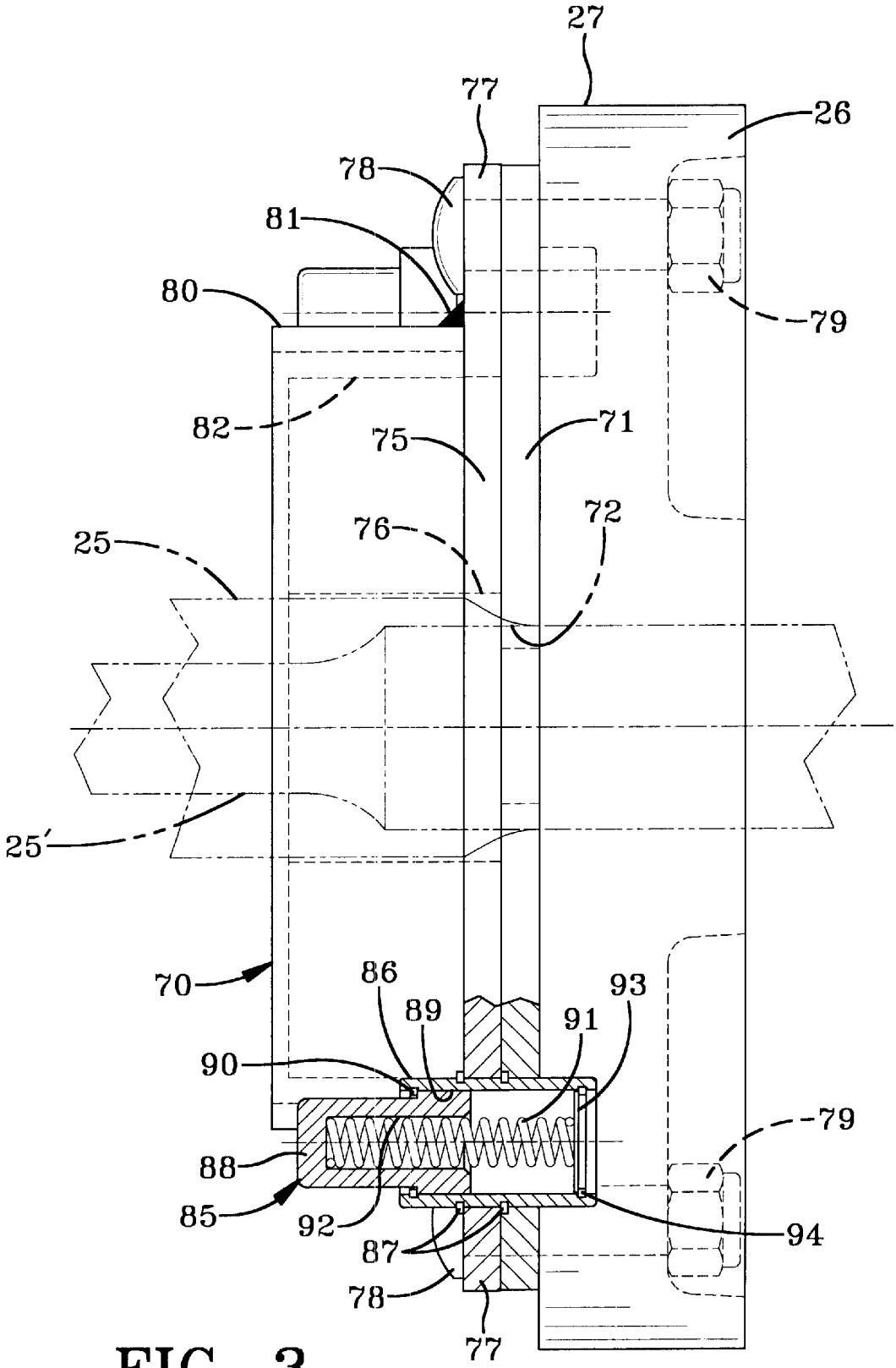
FIG. 3 is an enlarged fragmentary elevational view with portions broken away and parts in section showing details of the magnetic spool drive and particularly the positive flange engagement mechanism.

The tension control device 10 of the present invention differs from applicant's assignee's above referenced patent in providing an improved spool drive assembly, generally indicated by the numeral 70 in the drawings. Referring particularly to FIGS. 2 and 3, the spool drive assembly 70 retains the spool S of filament F for rotation with the circular plate 26 constituting the brake drum. The spool drive assembly 70 includes a mounting pad 71 which is in engagement with the circular plate 26 and receives spindle 25 through an aperture 72 located centrally thereof. Positioned to the other side of the mounting pad 71 from the plate 26 is abase 75 of the spool drive assembly 70. The base 75 is preferably a magnetically conductive material which also has a central aperture 76 to receive the spindle 25. The base 75 includes a pair of projecting ears 77 which are preferably substantially diametrically opposed, as best seen in FIG. 1. The ears 77, mounting pad 71 and plate 26 are bored to receive bolts 78 with engaging nuts 79 to attach the base 75 and mounting pad 71 to the plate 26 constituting the brake drum of the tension control device 10. Extending axially outwardly from the base 75 is a tubular sleeve 80 which is also preferably constructed of a magnetically conductive material. The tubular sleeve 80 is attached to the base 75 as by a plurality of circumferentially spaced welds 81 (FIG. 3). Housed within the tubular sleeve 80 and the base 75 is an annular magnet 82 which is fixed to the base 75 as by an adhesive. The magnet 82 is substantially the same axial dimension as the tubular sleeve 80 but is preferably slightly shorter as shown in FIGS. 2 and 3.

The spool drive assembly 70 also includes a positive flange engagement mechanism, generally indicated by the numeral 85. The positive flange engagement mechanism 85 is best seen in FIGS. 1 and 3 mounted on the ears 77 of the base 75 and projecting axially outwardly a distance preferably slightly less than the tubular sleeve 80 of the base 75. While a single positive flange engagement mechanism 85 might be successfully employed, two or more of the positive flange engagement mechanisms 85 are preferred to carry out the operative features thereof described hereinafter. As shown, a pair of substantially diametrically opposed positive flange engagement mechanisms 85 are shown, one on each of the ears 77 of base 75.

Each positive flange engagement mechanism 85 includes a slide tube 86 which is secured to the ears 77 by a pair of retaining rings 87, 87. A plunger 88 is mounted for movement axially of the slide tube 86 and has a cylindrically bearing surface 89 engaging the inner surface of the slide tube 86. The plunger 88 normally extends a substantial distance axially outwardly of the slide tube 86. A retaining ring 90 maintains plunger 88 within the slide tube 86.

The plunger 88 of positive flange engagement mechanism 85 is biased toward its extended position depicted in FIG. 3 of the drawings by a compression spring 91. The compression spring 91 has one end positioned in a bore 92 in the plunger 88 with the opposite end seated against a circular disk 93 which is retained within the slide tube 86 by a retaining ring 94. Thus, it will be apparent that the plunger is urged toward the extended position depicted in FIG. 3 by the spring 91, except when the plunger 88 is axially inwardly deflected, but returns to the normal extended position by operation of the spring 91.

The spool drive assembly 70 is designed to operate with a spool S configured as generally depicted in FIGS. 1 and 2 of the drawings. As shown, the spool S is exemplary of the metal spools employed in the tire industry for dispensing wire used in the fabrication of steel-belted radial tires. As shown, the spool S has a cylindrical drum portion 95 which is bounded at each axial extremity by radially projecting circular flanges 96. The flanges 96 normally have outwardly projecting radially extending reinforcing ribs 97 at spaced circumferential locations about the entire circumference of the flanges 96. Radially interiorly of the ribs 97 the flange 96 has a central contact area 98 which, as shown, may be an inwardly directed circular recess having a central bore 99 through which the spindle 25 extends.

In operation spools S loaded with filament F are either manually loaded onto the spindles 25 or powered creel loaders with spool grasping devices may be employed due to the weight of a metal spool when it is loaded with wire filament. As there is no requirement for alignment with a fixed pin or other drive member associated with the spool drive assembly 70 according to the present invention, the bore 99 of spool S may be randomly slid on the spindle 25 into engagement with the spool drive assembly 70. The position of a spool S seated against spool drive assembly 70 is depicted in FIG. 2 wherein it is to be noted that the tubular sleeve 80 and magnet 82 seat within the central contact area 98 in a flange 96 of a spool S, with the plunger 88 engaging a flange 96 of spool S and preferably being depressed from its extended position.

During normal letoff of the filament F from a spool S the rotational speed is normally sufficiently uniform such that there are only minor forces tending to cause slippage between the spool and the spool drive assembly 70. When such forces do occur, the force of the magnet 82 with respect to the central contact area 98 of spool S coupled with the engagement of the plunger 88 of the positive flange engagement mechanism 85 as seen in FIG. 1 is sufficient to preclude relative rotation of spool S relative to spool drive assembly 70. In the event of loping or other minor variations in filament tension the engagement of plunger 88 of positive flange engagement mechanism 85 with a rib 97 of the spool flange 96 is sufficient to stop any relative motion between the spool S and the spool drive assembly 70. In the event of extreme acceleration in the rate of payout of filament F, the plunger 88 of the positive flange engagement mechanism 85 may temporarily retract so that the spring loaded plunger 88 may slip past one or more ribs 97 in flange 96 until uniform rotation between spool S and spool drive assembly 70 is reestablished and normal operation is resumed. Significantly, the tubular sleeve 80 and magnet 82 remain engaged with central contact area 98 of spool S such that the spool S is not inclined to become magnetically disengaged from the spool drive assembly 70 under even the most extreme operating conditions. This is true even in the instance of no inclination of spindle 25 relative to the mounting plate 20, wherein there is no gravity assistance in maintaining spool S seated on the spool drive assembly 70.

Thus it should be evident that the disclosed tension control device with the spool drive assembly 70 carries out one or more of the objects of the invention set forth above. As will be apparent to persons skilled in the art, modifications can be made in the aforedisclosed structure to accommodate spools having slightly different dimensions or design characteristics without departing from the spirit of the invention herein disclosed and described, the scope of the invention being limited solely by the scope of the attached claims.

What is claimed is:

1. A spool drive for selectively retaining a spool having a pair of end flanges with radial ribs and a central contact area about a bore while filamentary material on the spool is payed out under tension comprising, a spindle adapted to receive the bore in the spool, a magnetic chuck surrounding and rotatable with said spindle, and a positive flange engagement mechanism associated with said magnetic chuck biased into contact with one of the pair of end flanges of the spool and adapted to engage the radial ribs to restrain rotational slippage between said magnetic chuck and the spool.

2. A spool drive according to claim 1, wherein said positive flange engagement mechanism has a projecting plunger for engaging the one of the pair of end flanges when the spool is seated on said magnetic chuck.

3. A spool drive according to claim 2, wherein said plunger is spring loaded.

4. A spool drive according to claim 2, wherein said magnetic chuck has a base and said plunger is mounted on said base.

5. A spool drive according to claim 4, wherein said magnetic chuck is mounted on said base and said plunger is mounted on an ear on said base positioned radially outwardly of said magnetic chuck.

6. Apparatus for paying out filamentary material comprising, a tension controller having a rotatably mounted spindle, a spool drive having a magnetic chuck rotatable with said spindle, a metal spool adapted to carry the filamentary material having a flange adapted to be seated on said magnetic chuck, and a positive flange engagement mechanism associated with said spool drive and engaging said flange of said metal spool to restrain rotational slippage between said magnetic chuck and said spool.

7. Apparatus for paying out filamentary material according to claim 6, wherein said flange of said spool has a plurality of radially extending ribs and said positive flange engagement mechanism has a plunger adapted to engage said ribs to restrain rotational slippage between said magnetic chuck and said spool upon the commencement of rotational slippage therebetween.

8. Apparatus for paying out filamentary material according to claim 7, wherein said plunger is spring loaded.

9. Apparatus for paying out filamentary material according to claim 7, wherein said spool drive has a base and said positive flange engagement mechanism is mounted on said base.

10. Apparatus for paying out filamentary material according to claim 9, wherein said magnetic chuck includes a magnet mounted on said base and said positive flange engagement mechanism has said plunger mounted on said base positioned radially outwardly of said magnet.

11. Apparatus for paying out filamentary material according to claim 10, wherein said plunger operates within a slide tube attached to said base and a spring biases said plunger into engagement with said flange of said spool.

12. Apparatus for paying out filamentary material according to claim 10, wherein said spool drive has a tubular sleeve interposed between said magnet and said plunger, with said tubular sleeve extending a greater distance from said base than said plunger.

13. Apparatus for paying out filamentary material according to claim 12, wherein said flange of said spool has a central contact area adapted to receive said magnet and said tubular sleeve while said plunger engages said flange of said spool radially outwardly of said central contact area.

14. Apparatus for paying out filamentary material according to claim 12, wherein said plunger operates within a slide tube attached to said base and a spring biases said plunger into engagement with said flange of said spool.

15. A spool drive for a tension controller for paying out filamentary material from a spool comprising, a rotatably mounted spindle, a base rotatable with and having said spindle projecting therefrom, a magnet mounted on said base and projecting in the same direction from said base as said spindle, and a plunger mounted on said base and extending and biased in the direction said magnet projects from said base.

16. A spool drive for a tension controller according to claim 15, wherein said plunger is spring loaded.

17. A spool drive for a tension controller for paying out filamentary material from a spool comprising, a rotatably mounted spindle, a base rotatable with and having said spindle projecting therefrom, a magnet mounted on said base and projecting in the same direction from said base as said spindle, and a means mounted on said base and extending and biased in the direction said magnet projects from said base.

18. A spool drive for a tension controller according to claim 17, wherein said means mounted on said base and extending and biased in the direction said magnet projects from said base is a spring loaded plunger.

19. A method of restraining relative motion between a spool drive of a tension controller and a spool containing filamentary material during variations in the speed of pay-out of the filamentary material comprising the steps of, mounting the spool drive having a magnet and a plunger for rotation with a spindle of the tension controller;

providing a metal spool having end flanges with radial ribs and a central contact area;

loading the metal spool on the spindle of the tension controller;

retaining the metal spool on the spool drive by the magnetic influence of the magnet; and mechanically supplementing the magnetic influence of the magnet by the plunger engaging the ribs on the flanges of the spool to further restrain relative motion between the spool and the spool drive.

20. A method according to claim 19, including the step of biasing the plunger into engagement with the flange of the spool.

21. A method according to claim 19, including the step of maintaining the spool within the magnetic influence of the magnet upon relative rotation between the spool and the spool drive by initially locating the magnet at least partially within a central contact area in the flange of the spool.

* * * * *